US010286713B2

(12) United States Patent
Hildreth et al.

(10) Patent No.: US 10,286,713 B2
(45) Date of Patent: May 14, 2019

(54) PRINTING USING REACTIVE INKS AND CONDUCTIVE ADHESION PROMOTERS

(71) Applicants: Owen Hildreth, Tempe, AZ (US); April Jeffries, Tempe, AZ (US); Avinash Mamidanna, Tempe, AZ (US); Mariana Bertoni, Mesa, AZ (US)

(72) Inventors: Owen Hildreth, Tempe, AZ (US); April Jeffries, Tempe, AZ (US); Avinash Mamidanna, Tempe, AZ (US); Mariana Bertoni, Mesa, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 15/729,978

(22) Filed: Oct. 11, 2017

(65) Prior Publication Data

US 2018/0099520 A1 Apr. 12, 2018

Related U.S. Application Data

(60) Provisional application No. 62/406,836, filed on Oct. 11, 2016.

(51) Int. Cl.
*H01B 1/02* (2006.01)
*B41M 7/00* (2006.01)
(Continued)

(52) U.S. Cl.
CPC ..... *B41M 7/009* (2013.01); *B41J 2/04505* (2013.01); *B41J 2/17* (2013.01);
(Continued)

(58) Field of Classification Search
CPC ..... B41M 7/009; B41J 2/04505; B41J 2/17; B05D 7/24; H05K 1/097; H05K 3/125;
(Continued)

(56) References Cited

U.S. PATENT DOCUMENTS 3,011,920 A 12/1961 Shipley, Jr.
3,762,981 A 10/1973 Blank
(Continued)

OTHER PUBLICATIONS

Bidoki et al., "Ink-Jet Fabrication of Electronic Components." J. Micromech. Microeng. 2007, 17, 967-974.
(Continued)

*Primary Examiner* — Hsien Ming Lee
(74) *Attorney, Agent, or Firm* — Michael Best & Friedrich LLP

(57) ABSTRACT

Methods and chemistries are described to form electrically conductive adhesion promoters for use with reactive inks. In some implementations, a metal ink is printed on a substrate. An adhesion promoter is deposited on the surface of the substrate. The adhesion promoter reacts to form a covalent bond with the substrate. Subsequently, a reactive metal ink is used to print on a substrate using a drop-on-demand printing process. The reactive metal ink includes metal cations that react with the adhesion promoter-treated substrate surface to form a conductive bond between the adhesion promoter-treated substrate surface and a metal of the reactive metal ink.

19 Claims, 7 Drawing Sheets

(51) Int. Cl.
*B41J 2/17* (2006.01)
*B41J 2/045* (2006.01)
*B41M 5/00* (2006.01)

(52) U.S. Cl.
CPC ..... *B41M 5/0017* (2013.01); *B41M 5/0023* (2013.01); *B41M 5/0011* (2013.01)

(58) Field of Classification Search
CPC ..... H01L 51/0022; H01L 27/1292; H01L 51/0004; H01L 51/0005
See application file for complete search history.

(56) References Cited

U.S. PATENT DOCUMENTS

| | | | | |
|---|---|---|---|---|
| 5,268,088 | A | 12/1993 | Okabayashi | |
| 5,342,501 | A | 8/1994 | Okabayashi | |
| 5,464,707 | A | 11/1995 | Moulton et al. | |
| 8,043,535 | B2 | 10/2011 | Kamikoriyama et al. | |
| 2003/0199162 | A1* | 10/2003 | Seki ..... | B82Y 30/00 438/681 |
| 2011/0036802 | A1 | 2/2011 | Ronsin et al. | |

OTHER PUBLICATIONS

De Minjer et al., "The Nucleation with SnCl[Sub 2]-PdCl[Sub 2] Solutions of Glass Before Electroless Plating." J Electrochem Soc 1973, 120, 1644.
Farraj et al., "Self-Reduction of a Copper Complex MOD Ink for Inkjet Printing Conductive Patterns on Plastics." Chem Commun 2015, 51, 1587-1590.
Lee et al., "A Novel Solution—Stamping Process for Preparation of a Highly Conductive Aluminum Thin Film." Adv. Mater. 2011, 23, 5524-5528.
Lee et al., "Long-Term Sustainable Aluminum Precursor Solution for Highly Conductive Thin Films on Rigid and Flexible Substrates." ACS Appl. Mater. Interfaces 2014, 6, 15480-15487.
Mo et al., "Effects of Dodecylamine and Dodecanethiol on the Conductive Properties of Nano-Ag Films." Appl Surf Sci 2011, 257, 5746-5753.
Tao et al., "A Facile Approach to a Silver Conductive Ink with High Performance for Macroelectronics." Nanoscale Research Letters 2013, 8, 1-6.
Walker et al., "Reactive Silver Inks for Patterning High-Conductivity Features at Mild Temperatures." J. Am. Chem. Soc. 2012, 134, 1419-1421.

* cited by examiner

| | $V_{oc}$ (mV) | $J_{sc}$ (mA/cm$^2$) | pFF (%) | FF (%) | $R_s$ (Ω•cm$^2$) | η (%) |
|---|---|---|---|---|---|---|
| *SP Paste Cell* | 713 | 35.9 | 81.3 | 76.3 | 1.1 | 19.5 |
| *DoD-RSI Cell* | 712 | 35.5 | 80.9 | 72.9 | 1.8 | 18.4 |

PRINTING USING REACTIVE INKS AND CONDUCTIVE ADHESION PROMOTERS

RELATED APPLICATIONS

This application claims the benefit of U.S. Provisional Patent Application No. 62/406,836, filed Oct. 11, 2016, entitled "PRINTING USING REACTIVE INKS AND CONDUCTIVE ADHESION PROMOTERS," the entire contents of which are incorporated herein by reference.

STATEMENT REGARDING FEDERALLY SPONSORED RESEARCH

This invention was made with government support under award number 1602135 awarded by the National Science Foundation. The government has certain rights in the invention.

BACKGROUND

The present invention relates to methods, systems, and materials for utilizing conductive inks and pastes. Silver pastes are currently used for photovoltaic applications, but the feature resolution achieved using silver pastes does not scale well below 50 μm, can damage delicate substrates, and may require thick layers to achieve the necessary conductivity. Applications such as thin-film or substrate photovoltaics, flexible electronics, and sensors may require high feature resolution, high conductivity, and "soft-handling."

SUMMARY

In various embodiments, the invention uses reactive inks to replace screen-printed inks and particle-based inks. Adhesion between a substrate and printed reactive inks can be achieved by printing onto "sticky" substrates (e.g., tapes or plastics) or by printing onto rough surfaces to form a mechanism bond between the ink and the substrate. However, these methods may create interfaces with high electrical resistivity that are not suitable for many applications—for example, photovoltaic cells require good electrical contact between the metallization layer and the underlying substrates.

In some embodiments, the invention provides a method and materials from creating a strong adhesion between the substrate and the printed reactive metal ink without sacrificing electrical conductivity between the substrate and the material printed with the reactive ink. The use of an adhesion promoter as described in this disclosure provides chemical bonds between the adhesion promoter and both the substrate and the metal ink providing reliable mechanical adhesion while also improving the electrical conductivity (i.e., reducing electrical resistivity) between the substrate and the material printed using the reactive ink.

In some embodiments, the invention provides a method using drop-on-demand (DoD) printing—also known as "inkjet" printing—for printing with conductive inks or pastes. Drop-on-Demand printing offers precise placement, minimum ink water, and good alignment without contact, but, when using particle-based inks in drop-on-demand printing, the inks may be expensive to manufacture and require low metal fill loadings to avoid nozzle clogging. In some examples, this disclosure proposes using reactive inks as a low-cost, higher performance alternative to particle-based inks. Unlike particle-based inks, reactive inks print "chemical reactions" that result in a high quality material at low temperatures without an annealing step.

In some embodiments, the reactive inks used in drop-on-demand printing processes include metal cations (from dissolved metal salts), reducing agents, ligands and chelating agents, and fluid property modifiers. Because some reactive metal inks show poor adhesion to metal and oxide surfaces, a printable adhesion promoter is described that provides good electrical conductivity to metals and oxides. In some embodiments, the adhesion promoter includes a solution containing tin chloride, polar solvent (water, ethanol, etc.), some acid (HCl, H2SO4, HNO3, etc.) to adjust the pH to between 0 and 7, along with droplet stabilizing agents to adjust viscosity and surface tension (2,3-butanediol, ethanol, acetone, glycerol, etc.). $Sn^{2+}$ from the tin chloride reacts with the Si—OH of a hydroxide-terminated silicon substrate to form a Si—O—Sn—OH or tin-terminated surface. Next, $Ag^{2+}$ ions from a silver-based reactive ink react with the OH or Sn terminated surface to form Si—O—Sn—Ag surface terminations that act as nucleation sites for further $Ag^{2+}$ reduction. The net result is a highly conductive interface with ohmic contact between the substrate (silicon is this example) and the printed metal. In various embodiments, the reactive ink may include one or more metals including, for example, silver, copper, gold, nickel, platinum, palladium, or iron.

In some embodiments, the substrate is "activated" by depositing an adhesion promoter solution via dip-coating, printing, spray coating, contact printing, drop-on-demand printing, continuous droplet-printing, or other printing/deposit processes. Next, the reactive ink is printed and the metal ions react with the Sn or Sn—OH terminated surface to nucleate metal particles with good adhesion to the substrate surface.

Other aspects of the invention will become apparent by consideration of the detailed description and accompanying drawings.

DETAILED DESCRIPTION

Figure 2A:
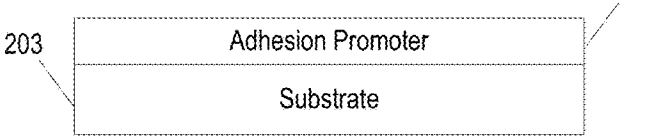
FIGS. 2A and 2B are cross-sectional schematic drawings of a substrate during the printing process of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Low resistance Ohmic contact formation often requires high temperatures in order to evaporate conductivity-limiting organic residues in conductive pastes or to sinter conductive particles. Unfortunately, these high temperatures are incompatible with many immerging technologies that include thermally sensitive substrates or layers, including flexible, lightweight wearable electronics printed on polymer, cloth or paper substrates, or high efficiency solar cells. Formation of high-conductivity metal contacts readily at mild temperatures broadens device application opportunities to include thermally-sensitive substrates and electronically-active layers.

Reactive metallic inks—such as nickel, copper, and silver—enable Drop-on-Demand (DoD) printing of highly conductive features at low temperatures (typically 35-120° C.) without the need of a post-deposition anneal. Reactive silver inks (RSI) are particularly attractive because Ag has the lowest electrical resistivity of all metals and its oxides are also reasonably conductive, so surface oxidation does not degrade performance as much as it does in a copper or nickel metallizations. In various examples described in this disclosure, RSI contacts are synthesized from silver acetate, formic acid, and ammonia. The printing process from this ink results in the reduction and precipitation of Ag among residual acetate groups. Maintaining the substrate at mild temperatures below 100° C. during ink deposition favors volatilization of the organic residues, resulting in RSI contacts exhibiting composition and conductivity nearly equivalent to that of pure Ag.

Metal contact formation also often requires patterning of micron-size features for optimal device performance, which can advantageously be addressed by piezoelectric DoD printing. This technique facilitates high-precision patterning of fine features without the need of additional masking steps, while also minimizing waste of precious metals in inks.

Currently the solar market is dominated by Si technology, predominantly diffused-junction solar cells that over the last decade exhibited a drastic increase in efficiency while lowering cost per watt. The highest efficiency for non-concentrated Si solar cells is held by amorphous Si (a-Si)/crystalline Si (c-Si) heterojunction (SHJ) cells with a reported efficiency of 25.6% for standard reference spectra (ASTM G173). However, a performance limitation of SHJ cells is high series resistance (Rs) that primarily results from the relatively high-resistivity, low-temperature Ag paste that is used to make front contacts. While diffused-junction Si solar cells can use high temperature annealing to form low resistance contacts from Ag pastes, SHJ cells are substantially more thermally sensitive, as the surface passivation—typically provided by hydrogenated amorphous silicon (a-Si:H)—begins to degrade at temperatures above ~200° C. Therefore, a major hurdle to achieving higher efficiency SHJ cells is in decreasing the overall Rs by reducing the metal resistivity and specific contact resistance. Our proposed combination of this advanced printing technique with RSI offers opportunities to benefit SHJ performance through (i) formation of highly conductive metal contacts to reduce series resistance, (ii) processing at low temperatures to prevent degradation of thermally sensitive layers, and (iii) reduced front contacts feature size to minimize shadowing effects and enhance current generation. Furthermore, these benefits are not only limited to SHJ solar cells, other thermally sensitive photovoltaic technologies such as perovskites, and organic photovoltaics, could see improved performance using RSI contacts.

Additionally, DoD printing of RSI is economically compelling by potentially reducing the amount of silver used and wasted in solar cell manufacturing. For DoD printed RSI contacts, very little Ag is wasted. First, all of the printed Ag is directly used to form contacts with little waste occurring during nozzle cleaning, whereas a lot of Ag paste is left on the screen following the conventional screen-printing process. Second, much finer features can be DoD printed; theoretically, screen-printed fingers on silicon solar cells typically 75-100-μm-wide and 20-30-μm-high could be replaced with printed RSI fingers as thin as 35 μm and a few microns in height, which reduces silver consumption from about 100 to less than 10 mg per cell while maintaining high fill factors.

Figure 1:
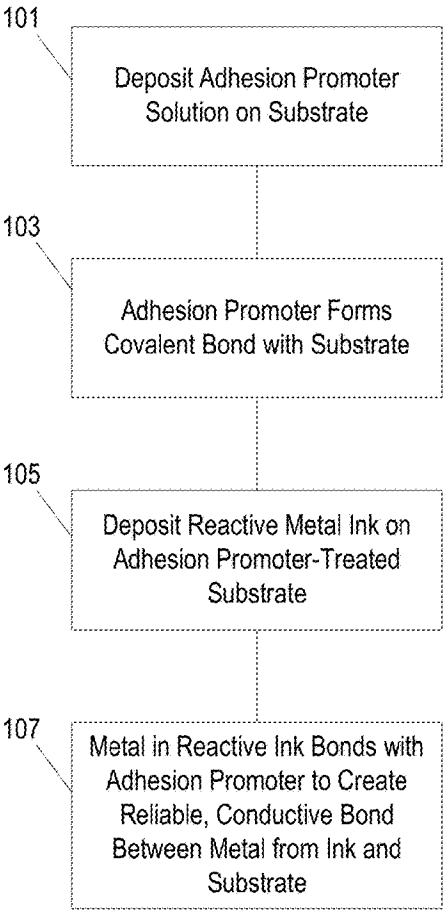
FIG. 1 is a flowchart of a method for printing metal ink on a substrate using an adhesion promoter according to one embodiment.

FIG. 1 illustrates a method for printing/depositing a metal on a substrate using a reactive ink and an adhesion promoter. First, an adhesion promoter solution is deposited on the substrate (step 101). In this example, the adhesion promoter is a solution containing tin chloride, a pH adjusting agent (e.g., acid, buffer, etc.), humectants (e.g., 2,3-butandiol or glycerol), a viscosity adjusting agent (e.g., ethanol, acetone, water, glycerol, or glyercin), a surface tension adjusting agent (e.g., ethanol, sodium citrate, or water), and a diluting solvent (e.g., water, ethanol, acetone, acids, or polar solvents). The adhesion promoter solution has a concentration between 1 femto-moles per liter and 20.84 moles per liter and has a pH between 0 and 7. For some implementations where the adhesion promoter solution is deposited on the substrate using drop-on-demand printing, the viscosity of the adhesion promoter solution is between 2-8 centipoise.

However, the precise composition of the adhesion promoter solution can be varied depending on factors such as, for example, the mechanism used to deposit the adhesion promoter on the surface of the substrate. For example, in some implementations, a dip-coating process is used. A mixture of 0.5 M tin (II) chloride solution in DI water mixed 1:1 by volume with a 0.5 M HCl is used as a sensitizing adhesion promoter. The substrate is dipped in the solution for 300 seconds, rinsed with DI water, and dried using $N_2$.

Alternatively, more precise deposition methods can be used to avoid exposing the entire surface of the substrate to the tin chloride adhesion promoter. For example, a drop-on-demand or inkjet printing process can be used to deposit the tin chloride adhesion promoter on a partial surface of the substrate or in a specific pattern on the substrate. Under these conditions, it may not be feasible to rinse the surface of excess tin chloride ions because rinsing could cause the tin chloride to contaminate other areas of the substrate. Therefore, the concentration of the tin chloride solution is adjusted so that, once the solution is dried, the tin chloride forms less than a monolayer on the substrate. If too much tin chloride solution is printed onto the surface, then excess tin chloride might remain as a salt instead of reacting and bonding to the substrate. The number of adhesion sites decreases as the concentration falls below the monolayer concentration.

The appropriate tin chloride concentration may also vary with dispensed volume and dispensed area. In one example, a 40 pL ($40\times10^{-15}$ $m^3$) droplet is printed onto a (111) silicon substrate and spreads out into a 100 μm spherical cap. The number of surface atoms per unit area, natoms, on (111) silicon is: ~natoms=$7.8\times10^{14}$ atom/$cm^2$. Spread across a 100 μm circular area, the total number of surface reaction sites, Nsites ~$61.3\times10^9$ and would require $98\times10^{-15}$ moles of tin chloride per dispensed droplet. A 40 pL droplet would require a tin chloride concentration of $2.47\times10^{-3}$ moles/liter.

After the adhesion promoter solution is deposited on the surface of the substrate (step 101), it reacts with the substrate material to form a covalent bond between the adhesion promoter and the substrate (step 103). For example, when a tin chloride solution is used as the adhesion promoter, the tin chloride reacts with hydroxyl groups on the substrate surface to form the covalent bonds. In some implementations, the adhesion promoter is allowed to dry or mostly dry before dispensing the reactive ink to ensure that the tin cations react with the substrate surface before reacting with the reactive ink. The substrate temperature can be increased to speed the reaction up and increase the solvent evaporation rate.

After the adhesion promoter has reacted with the substrate (step 103), a reactive ink is deposited on the adhesion promoter-treated surface of the substrate (step 105). In some implementations, the reactive ink is deposited using a printing process such as, for example, drop-on-demand printing. The reactive ink can include, for example, a silver-diamine ink or a copper formate complexed with 2-amino-2-methyl-1-propanol (CuF-AMP)[3]. In one implementation, the silver-diamine ink includes 1.0 g of silver acetate ($C_2H_3AgO_2$, anhydrous 99%, Alfa Aesar) dissolved in 2.5 mL ammonium hydroxide ($NH_4OH$, 28-30 wt %, ACS grade, BDH Chemicals). The solution is then stirred for two minutes on a vortex mixer to dissolve the silver acetate. Next, 0.2 mL of formic acid ($CH_2O_2$, ≥96%, ACS reagent grade, Sigma Aldrich) is added in two steps with a quick stir at the end of each step. The ink is then allowed to sit for 12 hours before being filtered through a 450 nm nylon filter. The reactive silver ink is then diluted 1:1 by volume with ethanol (EtOH, $C_2H_6O$, ACS reagent grade, Sigma Aldrich) and then filtered again through the 450 nm nylon filter immediately before use.

The ink composition is driven by the reduction of a diaminesilver (I) complex stabilized in excess ammonia (greater than or equal to a 4:1 ratio). The diaminesilver complex is formed as follows:

$$2AgCH_3CO_2 + 2NH_4OH \xrightarrow{H_2O} Ag_2O + 2NH_4CH_3CO_2 + H_2O$$

$$Ag_2O + 4NH_3 + 2NH_4CH_3CO_2 + H_2O \xrightarrow{NH_3/H_2O} 2Ag(NH_3)_2CH_3CO_2 + 2NH_4OH$$

The ink contains diaminesilver (I) cations, acetate anions, and formate anions and is stable at room temperature as long as an excess of ammonia is present in solution. The excess ammonia evaporates once printed, triggering the reduction of the silver diamine to silver and silver acetate:

$$2Ag(NH_3)_2CH_3CO_2 + NH_4CO_2 \xrightarrow{\Delta} 2Ag + 5NH_3 + 2CH_3CO_2H + CO_2 + H_2O$$

$$2Ag(NH_3)_2CH_3CO_2 + NH_4CO_2 \longrightarrow Ag + AgCH_3CO_2 + 5NH_3 + CH_3CO_2H + CO_2 + H_2O$$

The metal cations in the reactive ink solution react with the treated surface to form strong, conductive bonds between the tin from the tin chloride adhesion promoter and the metal (step 107). The resulting substrate-Sn-metal interface is mechanically strong and possesses low interfacial electrical resistance.

Figure 2B:
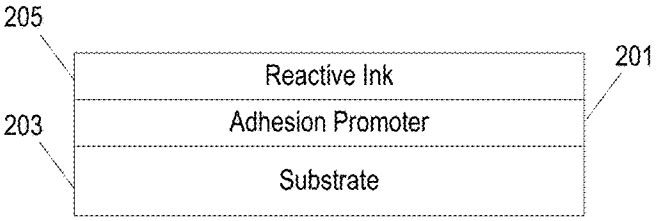

FIGS. 2A and 2B illustrate the process of FIG. 1 graphically. As shown in FIG. 2A, an adhesion promoter 201 is deposited on a substrate 203. After the adhesion promoter 201 reacts with the substrate 203, the reactive ink 205 is printed on the surface of the adhesion promoter-treated substrate as shown in FIG. 2B.

In another specific example, a solution of 3 mM tin (II) chloride ($SnCl_2$) is created by dissolving 5.69 mg of $SnCl_2$ in 10 mL of deionized water (DI, 18 MΩ, $H_2O$). This solution is then mixed 1:1 by volume with 3 mM HCl to form an adhesion promoter solution with a final $SnCl_2$ concentration of 1.5 mM. Before the adhesion promoter solution is printed on the substrate, the substrate is cleaned under $O_2$ plasma to remove organic contaminants. For initially "clean" substrates (e.g., substrates that have not been handled), the $O_2$ plasma clean is done at 50 W for 60 seconds in 20% $O_2$ and 80% Ar (by volumetric flow rate).

Samples are printed at ambient temperature using a Microfab Jetlab II inkjet printing system with a precision XY-translation stage and digital pressure controller. The Jetlab II is equipped with an MJ-ATP-01 piezoelectric-driven print head with a 60-μm-wide orifice coated with a diamond-like coating to reduce wetting. Drop volume, velocity, and quality are observed using a horizontal camera and strobe light. Samples are printed with the substrate held between 51 and 107° C. as measured using a k-type thermocouple in contact with the top surface of the substrate. In various implementations, the substrate includes $SiO_2$, Si, and Indium Tin Oxide (ITO) coated photovoltaic cells.

A single pass of adhesion promoter is printed using the MJ-ATP-01 printhead. The printhead is primed and then the waveform driving the piezoelectric printhead adjusted to form stable droplets. The diameter of the droplet in the air is measured using the side camera attached to the printer and range from 20-60 μm depending on ambient humidity and nozzle health. A droplet is printed onto the substrate and the diameter is measured using the calibrated top-down camera attached to the printer. A typical spot size is between 100 and 180 μm depending on droplet size, substrate material, and ambient humidity. Next, the pitch is set to 0.18× to 0.25× that of the spot size—typically between 20 μm and 35 μm. The adhesion promoter is printed in the location(s) and pattern(s) that the reactive ink will be printed.

Reactive silver ink contact features are printed in ambient atmosphere using a Microfab Jetlab II inkjet printing system, with a precision XY-translation stage and digital pressure controller. The Jetlab II is equipped with an MJ-ATP-01 piezoelectric-driven print head with 60-μm-wide orifice coated with a diamond-like coating to reduce wetting. Drop volume, velocity, and quality are observed using a horizontal camera and strobe light. Samples were printed with the substrate held between 51 and 107° C. as measured using a k-type thermocouple in contact with the top surface of the substrate. The silver diamine ink was printed on-the-fly at 5 mm/sec with 25 μm pitch (results in a 200 Hz ejection frequency). All drop-on-demand reactive silver ink contacts are printed with five passes of the print head.

To evaluate the performance of the reactive ink printing, 7×7 $mm^2$ contact pads are formed from SP paste and DoD RSI on electrically insulating substrates for bulk media resistivity measurements by four-point probe. For bulk optical property measurements by spectrophotometry, 2×2 $cm^2$ SP paste and DoD RSI contact pads were deposited on thin glass slides. The DoD RSI contact pads were printed at 51, 78 and 107° C., whereas the SP paste contact pads were formed at room temperature and annealed in a muffle furnace in air for 20 min. at 200° C.

Figure 3A:
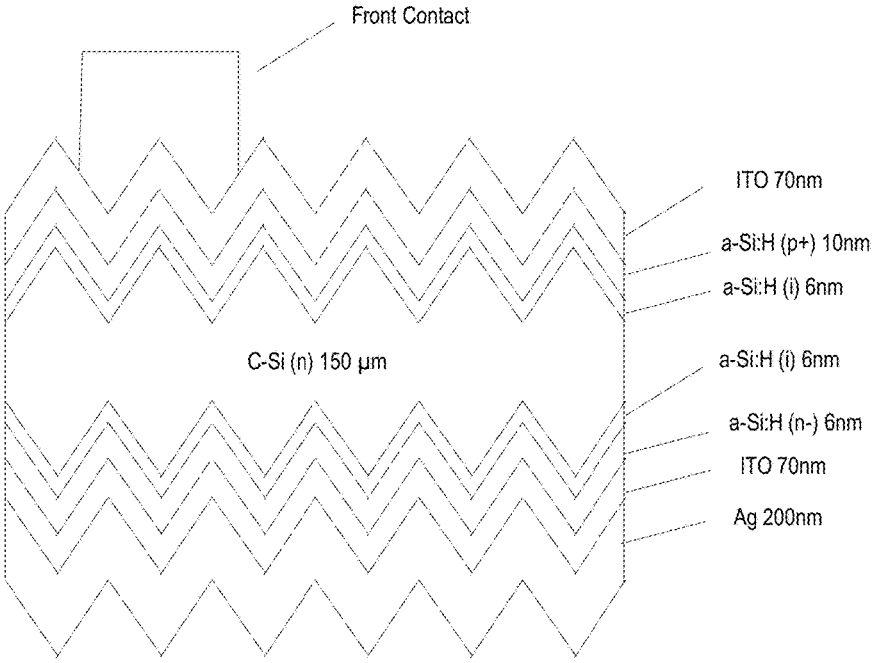
FIG. 3A is a cross-sectional schematic drawing of a silicon heterojunction (SHJ) cell layers.
Figure 3B:
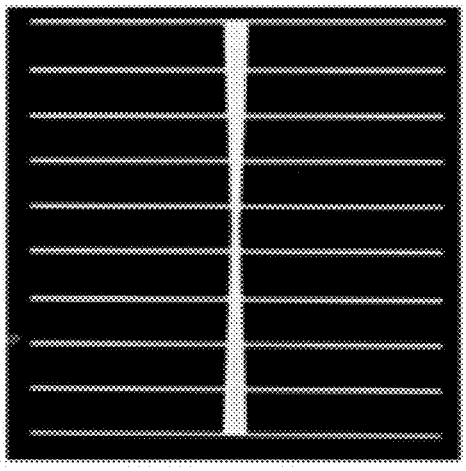
FIG. 3B is an overhead image of the silicon heterojunction (SHJ) of FIG. 3A with a front contact grid formed from screen-printed silver paste ("SP paste").
Figure 3C:
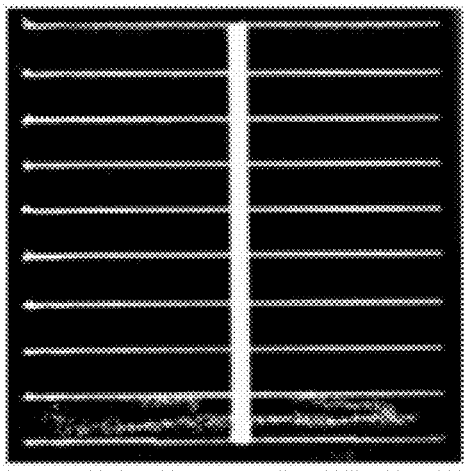
FIG. 3C is an overhead image of the silicon heterojunction (SHJ) of FIG. 3A with a front contact grid formed from drop-on-demand printed reactive silver ink ("DoD RSI").

SHJ solar cell samples were fabricated from 5×5 inches 180-μm-thick 1-5 Ωcm, n-type CZ Si wafers. First, the wafers were chemically textured and cleaned using chemical baths of KOH, piranha, RCA-B and buffered hydrofluoric acid solutions. Next, intrinsic and doped a-Si:H layers were deposited using plasma-enhanced chemical vapor deposition. Cells were then defined by DC sputtering deposition of tin-doped indium oxide (ITO) layers (~80 ohm) through a 2×2 $cm^2$ shadow mask. The back contact ITO and Ag were also DC sputtered as full blanket. As illustrated schematically in FIG. 3A, the complete stack and thicknesses are: ITO 70 nm/(p) a-Si:H 10 nm/(i) a-Si:H 6 nm/(n) c-Si 180 μm/(i) a-Si:H 6 nm/(n) a-Si:H 6 nm/ITO 70 nm/Ag 200 nm. FIG. 3B illustrates an example of one of the front contact grids prepared by screen-printing a low-cure-temperature silver paste (SP paste) from Namics Corporation. FIG. 3C illustrates an example of one of the front contact grids prepared using DOD RSI.

Next, all samples were annealed in air at 200° C. for 20 min. in order to recover damage incurred during ITO sputtering deposition, in addition to curing the SP paste at the maximum tolerable temperature for the a-Si:H. Finally, front metallization is prepared according to the above-described RSI printing recipe at 78° C. on annealed SHJ cells.

Reflectance was measured from 300 to 1200 nm on a UV-vis-nIR spectrophotometer with an integrating sphere. Solar cell performances were characterized by one-sun and suns-Voc current-voltage (I-V) measurements using a Sinton FCT-400 Series Light IV Tester. Surface morphology and cross-sectional thickness of the printed structures were characterized using Field Emission Scanning Electron Microscope at an accelerating voltage of 10.0 kV. The metal/ITO/Si specific contact resistance was assessed by transfer length measurements (TLM) method.

Figure 4:
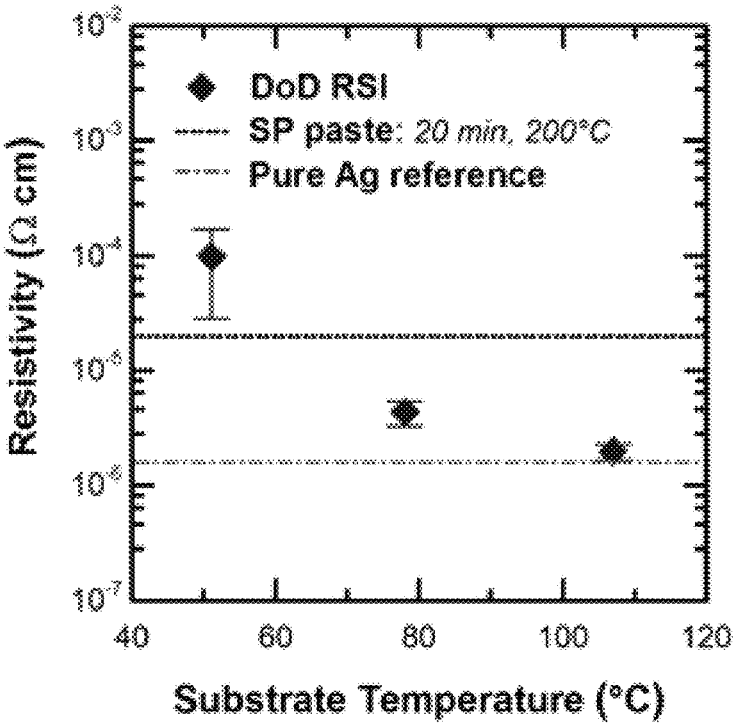
FIG. 4 is a graph of the resistivity of contact pads formed from DoD RSI for various substrate temperatures compared to the resistivity of pure Ag, and SP Ag paste after curing for 20 minutes at 200° C.

FIG. 4 shows a graph of the media resistivity of 7×7 mm2 contact pads prepared at various substrate temperatures. For reference, FIG. 4 also displays the resistivity of pure metallic Ag (1.6 μΩcm), and resistivity of the 7×7 $mm^2$ SP paste contact pads after curing for 20 min at 200° C. (20 μΩcm). At 51° C. the DoD RSI contact pad exhibits an average resistivity of 100 μΩ·cm, 5 times higher than values of the SP paste contact pad. This RSI recipe uses ethanol as a solvent, which has a boiling point of 78° C. Upon increasing the substrate temperature to 78° C., the DoD RSI pad resistivity decreases with an average of 4.4 μΩ·cm. This is only about 2.5 times the resistivity of pure bulk Ag and still an order of magnitude less resistive than contacts from cured SP paste. The resistivity of this ink can approach that of pure Ag with removal of residual organics, which is accelerated as substrate temperature is elevated, optimally above 90° C. Heated at 78° C. the RSI printed pad likely still contains traces of these residuals, resulting in a slightly higher resistivity than pure Ag. We observe an even lower resistivity of 2.0 μΩ·cm for the contact pad at a substrate temperature of 107° C. Since the DoD RSI contact pads were deposited in ambient atmosphere, oxidation of Ag is expected to occur at elevated temperatures, resulting in resistivity slightly higher than pure Ag. Furthermore, the DoD RSI contact pad has a porous structure (see FIG. 5). As porosity of a metal increases, the resistivity increases disproportionately due electron-energy loss through the path of irregularly contacted particles in the porous contact pad, which further explains some discrepancy with pure Ag resistivity. Moreover, the high surface area exposed to air in these porous contact pads can favor oxidation. Therefore, resistivity of the DoD RSI contact pads is expected to approach that of pure Ag by optimization of: (i) the substrate heating temperature to remove all residual organics, (ii) the RSI recipe to reduce porosity, and (iii) by printing in an inert atmosphere to eliminate oxidation at elevated temperatures.

Figures 6, 7:
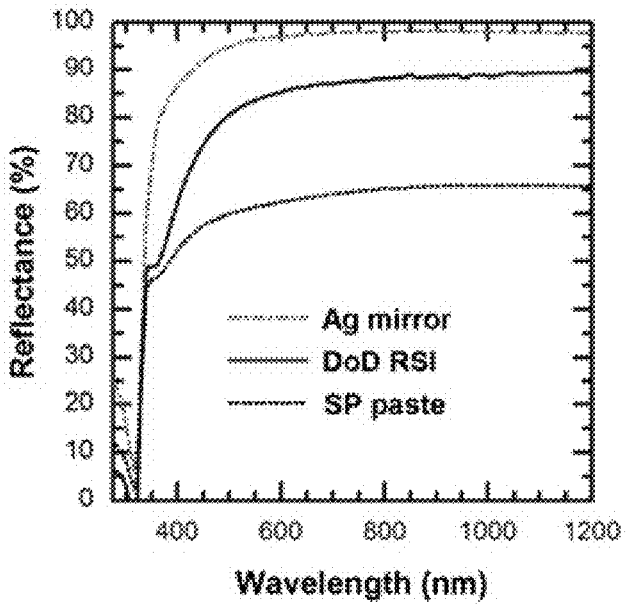
FIG. 6 is a graph of the reflectance spectra of a DoD RSI contact pad, a SP paste contact pad, and a pure Ag mirror.
FIG. 7 is a table of solar cell electrical characteristics for a SP paste cell and a DoD RSI cell.

FIG. 6 shows total reflectance spectra of 2×2 cm2 contact pads formed from SP paste and DoD RSI compared to a smooth, pure Ag mirror. Transmittance measurements (not shown) in the same spectral range for both the DoD RSI and SP paste contact pads showed that no light was transmitted through the pads printed on a flat glass surface. The spectrum of the DoD RSI contact pad shows 85-90% reflectance above the characteristic absorption edge of Ag around 310-325 nm, which is lower than the mirror Ag (95-98%); it also shows a distinct dip around 350 nm. These are characteristics a rough Ag surface. The dip in reflectance is attributed to absorption of the light by surface plasmons on the surface features of the DoD RSI contact pad, which is negligible for the smooth Ag mirror. Decreased reflectance from 350-1200 nm can have a different origin. It can result from scattering of light in the porous metal structure and enhanced absorption, or the presence organic residues, which absorb light. For the entire spectral range shown in FIG. 6, the SP paste contact pad exhibits lower reflectance than the Ag mirror and the DoD RSI contact pad, likely due to presence of absorbing organics and polymers and a lower fraction of Ag particles. Interestingly, the highly reflective nature of the DoD RSI contact pad could be beneficial for use as a back contact for a Si solar cell where it also act as a light reflector to increase absorption in the Si.

As discussed above in reference to FIGS. 3A, 3B, and 3C, SHJ cells can be prepared with front contact grids formed from DoD RSI, or from SP paste. In the examples discussed herein, all solar cells were prepared identically except for the front contacts. "Fingers" for both cells were spaced 2 mm apart; the finger widths and height were 100-130 μm and 20-25 μm for the SP paste cell, and with larger variability 75-145 μm and 1-5 μm for the DoD RSI cells, respectively. Note that the fingers width is relatively similar for both types of preparation; however, the SP paste fingers are 5-10 times taller. In terms of shadowing, the DoD RSI fingers are on average narrower than SP paste, which should result in lower current generation losses. However, the SP paste cell has a tapered bus bar, with an area of ~14 $mm^2$, compared to 12 $mm^2$ for DoD RSI cell respectively. This could overall compensate for finger-width shading effects in current. However, slightly higher shading and thus lower current generation is expected in the DoD RSI cell. In at least some implementations, the effect of finger width on series resistance is negligible and the difference in width from both types of front contacts negligible compared to the order of magnitude difference in the bulk resistivity. In the particular example of FIG. 3C, additional metallization spots may occur on the bottom region of the DoD RSI cell, originating from instability of the ink droplet formation during printing. These spots act as additional shading which, if significant, can result in further reduction of photocurrent but should be avoidable with optimization of the printing process.

As discussed above, FIG. 5 shows an SEM cross-sectional image of a DoD RSI finger contact on a SHJ solar cell. The DoD RSI finger presents a porous morphology of small interconnected spherical particles about 25-250 nm in diameter; this results in non-uniform coverage of the cell surface, leaving areas of the textured pyramid tips exposed. Printing on the textured surface alters the RSI structure as compared to printing on a flat substrate, as the dispensed ink droplets flow to the trough of the textured valleys, between textured pyramids before nucleating. The resulting morphology on textured surface is expected to influence the RSI finger contact properties. First, in thinner and more porous fingers, current transport via percolation will be limited by the lower order of connectivity of conductive Ag particles, leading to higher resistance. Second, the poor contact coverage between the Ag particles and the ITO surface can alter interfacial specific contact resistance. These two effects can impact the solar cell series resistance. Third, the adhesion and reliability of the contact might suffer from non-uniform coverage. Finally, the openings through the DoD RSI finger contacts might transmit some light through the peaks to the Si and hence allow a beneficial increase in current photogeneration.

Ideal solar cell front contacts would have minimal electrical resistivity, and be completely transparent. In a realistic solar cell, optimization of the front contact geometries can mitigate the tradeoff between power losses from shading of wide fingers while minimizing the current carrying capacity of fingers with a small cross sectional area. Solar cell front contact geometries with narrow finger of high cross-sectional area (high aspect ratio) are expected to yield the best performance. Interestingly, as is discussed below, the solar cells prepared with DoD RSI front contacts perform comparably to the SP paste solar cell—with very little process optimization—despite finger geometry with low aspect-ratio, high porosity, and poor adhesion, showing there is room for improvement. This calls for further investigation of the light interaction with the RSI material structure.

Furthermore, the electrical contact properties are assessed by evaluating the specific contact resistances (ρc) measured by transfer length measurements on fingers formed from DoD RSI and SP paste. The ρc values of SP paste to ITO range from 4-10×10−3 $\Omega cm^2$, whereas the range of values for DoD RSI fingers to ITO is 1-60×10−4 $\Omega cm^2$. These ρc values are typical of those reported for Ag pastes to ITO. On average, the DoD RSI ρc values are one order of magnitude lower, suggesting lower interfacial resistance, likely linked to the order of magnitude lower resistivity of the DoD RSI contacts compared to SP paste. Regarding the larger dispersion, we suggest that where the interfacial contact between the DoD RSI Ag particles and ITO is higher, the ρc is at the lower end of the range reported, whereas fingers with less interfacial connectivity result in ρc in the higher end of the range. The morphology of the substrate surface and resulting DoD RSI fingers seem therefore to control the final influence on the cell series resistance.

Figure 5:
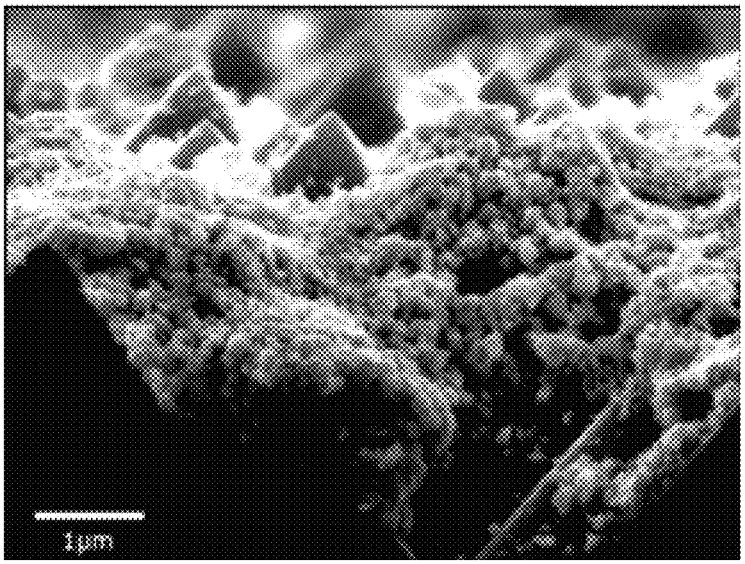
FIG. 5 is a scanning electron microscope cross-sectional image of a porous DoD RSi "finger" on a textured SHJ solar cell.
Figure 8:
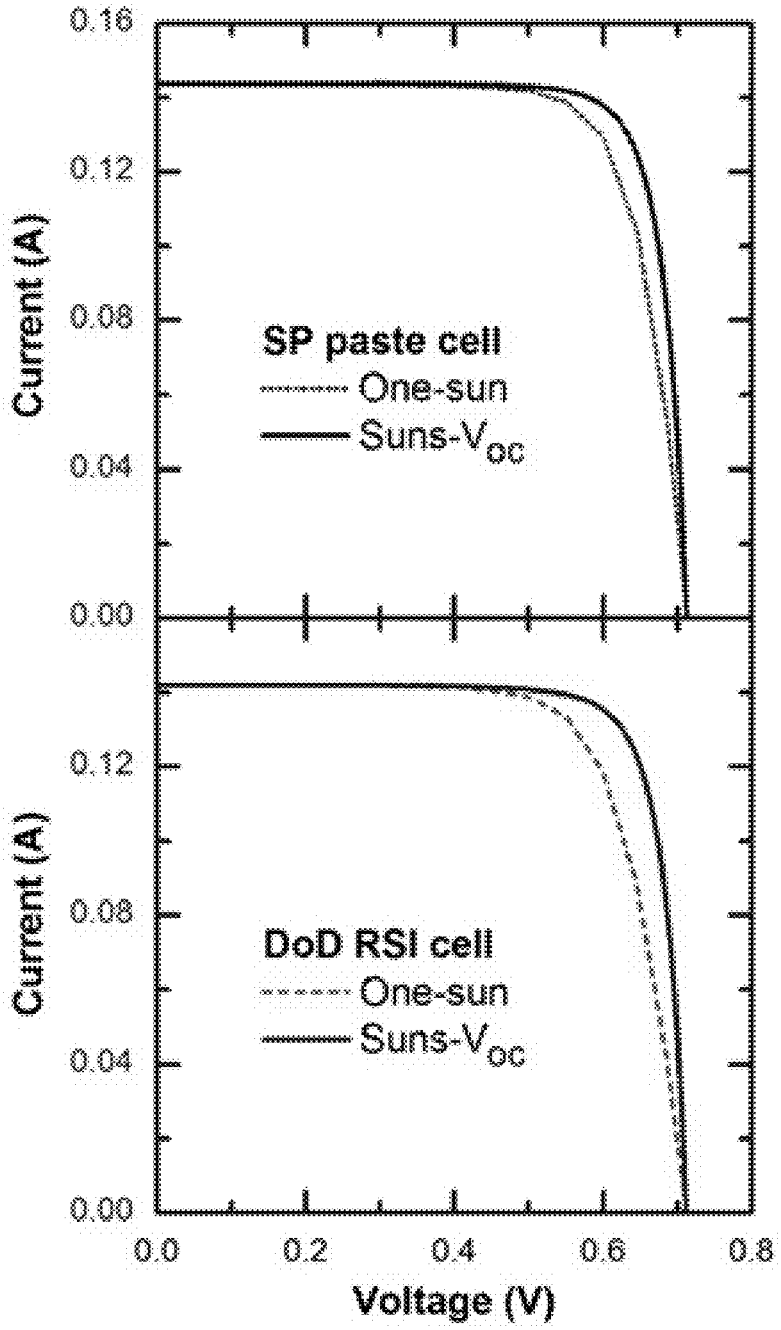
FIG. 8 is a pair of graphs of one-sun and suns-$V_{oc}$-I-V curves for SHJ solar cells with front contacts formed from SP paste (top) and from DoD RSI (bottom).

In order to compare the effect of front grid metallization method on solar cell performance, we extract and compare pseudo-fill factors (pFF), fill factors (FF), open-circuit voltage (Voc), short-circuit current density (Jsc), and series resistance (Rs) (see FIG. 7). FIG. 8 shows the I-V characteristics of the SP paste and DoD RSI cells. Suns-Voc I-V, used to extract pFF and Rs, is a measure of solar cell electrical response without the effects of series resistance. First, both cells exhibit similar pFF, the DoD RSI cell pFF is 0.4% lower than for the SP paste cell. Therefore in the absence of Rs, the cells perform comparably, with the DoD RSI cell only at a marginal disadvantage. This difference in pFF might originate from minor deviations in reproducibility from sample to sample. Moreover, the SP paste cell and DoD RSI cell demonstrate similar Voc of 713 and 712 mV, and close values of Jsc of 35.9 and 35.5 $mA/cm^2$, for the Ag paste vs. DoD RSI cell, respectively. Approximately 0.2 $mA/cm^2$ difference in $J_{sc}$ is expected from the difference in bus bar shading from the two cells. The remainder of the $J_{sc}$ difference probably originates from additional shading from the extra metallization spots from RSI printing instability as discussed above (shown in part (c) of FIG. 3); it also is possible that this part of the shading was offset by additional absorption of light through the textured peaks that poke through the DoD RSI fingers as shown in FIG. 5.

The similarity in pFF, $J_{sc}$, and $V_{oc}$ for both types of cells are consistent with the assumption that only the difference in front grid metallization methods affect Rs. Next, we compare the suns-Voc and one-sun IV responses. This method is one of the most reliable ways to quantify Rs in a solar cell. Rs (shown in FIG. 7) is calculated from the voltage difference (ΔV) at maximum power point (MPP), from the suns-$V_{oc}$ and one-sun I-V curves:

$$R_s = \frac{\Delta V}{J_{MPP,OneSun}}. \tag{1}$$

Solar cell series resistance $R_s$ is a lumped term that is comprised of: (a) the metal contact resistance, (b) the metal-semiconductor interfacial resistance, and (c) the resistance through the semiconductor stack. Again, since the solar cells in our sample set are prepared identically except for the front contact formation method, the difference in $R_s$ can be assumed to only result from differences in points (a) and (b). Increasing $R_s$ is also exhibited by power loss. This is shown by an increase in absolute FF loss from the suns-$V_{oc}$ and the one-sun I-V curves, that is, the difference between pFF and FF. Front grid contributions to power loss have been described and derived, where the power loss associated with (a) the resistance of the front grid is:

$$P_{grid} \propto \frac{\rho_{grid}}{tw} \propto \frac{R_{grid}}{L} \tag{2a}$$

and, (b) the interfacial grid/semiconductor resistance is:

$$P_{interface} \propto \sqrt{\rho_c}, \tag{2b}$$

where ρc is the specific contact resistance, $\rho_{grid}$ the resistivity of the metal grid, t the thickness, w the width, and L the length of the grid. The SP paste, and DoD RSI cells demonstrate absolute FF loss of 5%, and 8%, respectively. Though the resistivity $\rho_{grid}$ of the SP paste contact is 5 times higher than the DoD RSI contact, the DoD RSI contacts have very low thicknesses t of about 1-5 μm, and have therefore a lower cross sectional area compared to the SP paste contacts 20-25 μm in height. To demonstrate this, resistance of 1-cm-long SP paste and DoD RSI fingers were measured: the SP paste finger resistance was 3.7Ω, whereas the DoD RSI was 10.2Ω.

Similarly, although the lowest ρc was demonstrated by the DoD RSI fingers, equation 2 (b) shows that the power loss depends on the square root of ρc associated with interfacial contact/semiconductor resistance. Therefore, in our case where ρc values have a wide range due to variations in interfacial connectivity of the porous DoD RSI finger to the ITO, the difference in the resistance of the contacts per unit length ($R_{grid}/L$) outweighs the benefit of lower average ρc. We suggest that this accounts entirely for the slightly lower performance of the cell with the RSI printed finger. This also shows that this is not an intrinsic problem to the DoD RSI contacts, but is rather linked to the optimization of printing parameters to deposit appropriate thickness and morphology on a textured Si and ITO surface.

First, before optimization, DoD RSI front contacts demonstrate narrower finger widths, lower resistivity, and lower specific contact resistance than the SP paste contacts. Second, SHJ cells with DoD RSI front contacts perform comparably to those with SP paste front contacts. As a result, DoD RSI front contacts have potential to exceed the performance of SP paste front contacts; this seems clearly to be only limited by optimization and design parameters. Thus, we propose the following path toward improved performance: (i) approach closer to pure Ag resistivity by reducing porosity, while removing all residual organics by optimizing ink dilution printing parameters and substrate heating, (ii) minimize Ag oxidation by printing in an inert atmosphere (iii) reduce shadowing from unwanted Ag spots by optimizing the RSI printing parameters for continuous stable droplet formation, (iv) finally find the optimal power loss tradeoff between porosity, contact thickness, and possible enhanced photogeneration by transmission of light through the exposed textured peaks of the solar cell, which calls for further investigation.

DoD-printing of reactive silver inks is a low-cost, low-waste, low-thermal budget method that enables formation of highly-conductive metallization schemes on temperature-sensitive devices, exemplified in this contribution for SHJ solar cell. We showed that DoD RSI produce almost purely metal narrow front contact features at temperatures as low as 51° C., with a high reflectivity and minimum resistivity of approximately 2.0 μΩcm. When printed at 78° C., we showed that a 1:1 (ink:ethanol) RSI recipe yields porous, high purity Ag features, with structure and contact properties depending on printing conditions and substrate morphology. SHJ cells with DoD RSI front contacts exhibited similar pFF, Jsc and Voc compared to state-of-the-art screen-printed silver paste front contacts. Cells with DoD RSI front contacts had series resistance of 1.8 Ω·cm2 compared to 1.1 Ω·cm2 for cells with SP paste. This shows that without optimization, DoD RSI front contacts perform similarly to SP paste contacts that have been custom-designed and commercially produced for this application and offer an alternative industrially relevant metallization method.

Furthermore, reactive metal inks, which print a chemical reaction, are expandable for other metals such as Cu, Al, and Ni, thus expanding opportunities for low-temperature metallization for other photovoltaics technologies. Other advanced metallization concepts, such as well-defined patterning of seed layers for electroplating, can also benefit from use of DoD printing of reactive metal inks.

Figure 9:
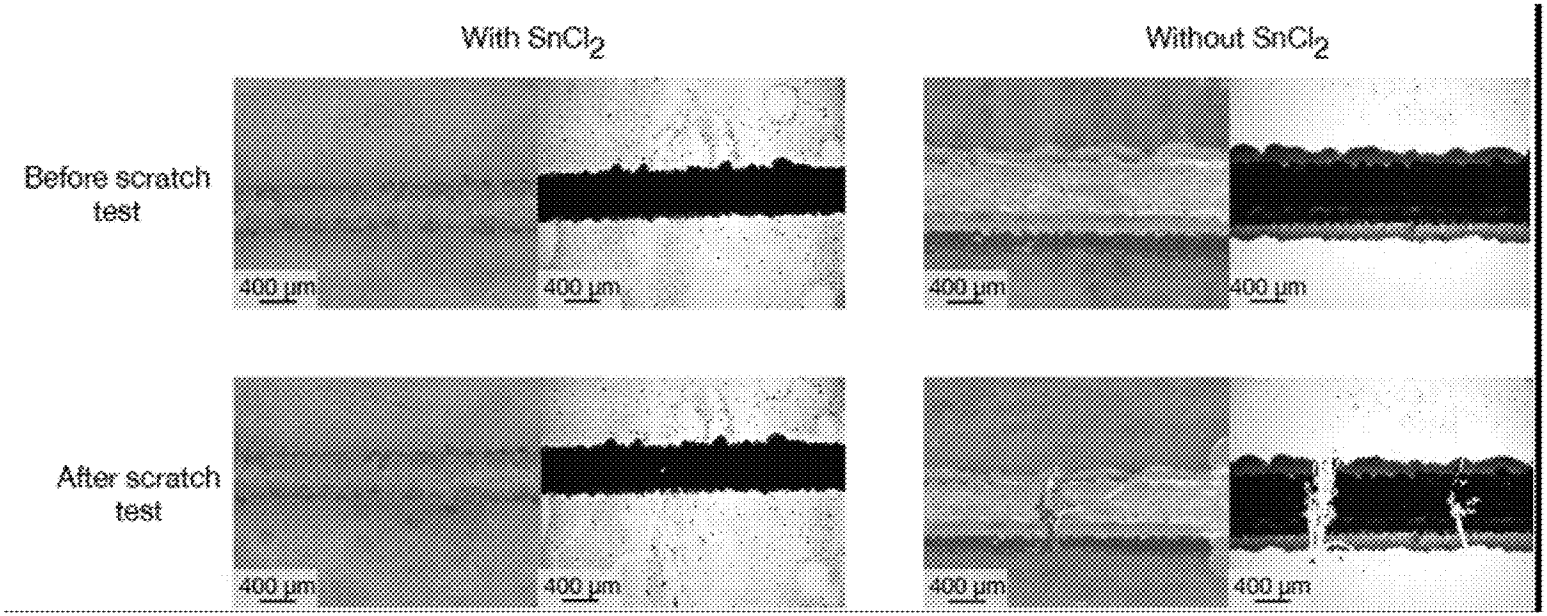
FIG. 9 is a series of overhead views of a metal ink printing on glass with and without the use of a $SnCl_2$ adhesion promoter both before and after a scratch test.
Figure 10:
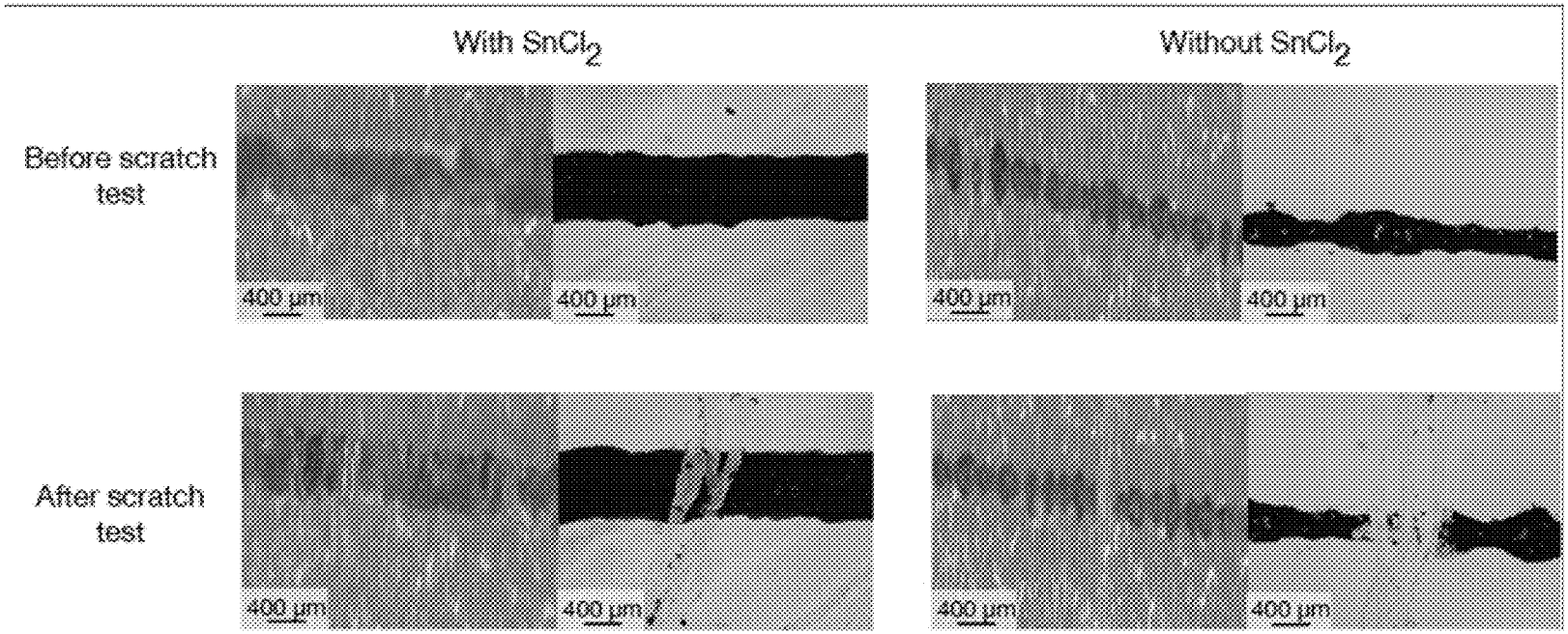
FIG. 10 is a series of overhead views of the metal ink printing on indium tin oxide (ITO) glass with and without use of the $SnCl_2$ adhesion promoter both before and after a scratch test.

Finally, FIGS. 9 and 10 demonstrate the improved adhesion of the metal inks on surfaces when a $SnCl_2$ adhesion promoter is utilized as described above. FIG. 9 shows four image pairs—each image pair includes an overhead view of a slide without backlight (left) and an overhead view of the same slide with backlight (right). In each image pair, a metal ink has been used to print on a glass slide. In the image pairs on the left, the glass slide was treated with a $SnCl_2$ adhesion promoter while no adhesion promoter was used on the slides in the images on the right. Each column shows a respective slide before (top) and after (bottom) a scratch test is performed to attempt to remove the metal ink from the glass slide. As demonstrated in the example of FIG. 9, very little of the metal ink was removed during the scratch test on the glass slide that was treated with the $SnCl_2$ adhesion promoter. However, in the slide that was not treated, the ink was removed to such a degree that the printed line no longer provides a conductive trace on the glass slide.

FIG. 10 similarly shows an example of a scratch test applied to samples of a metal ink printed on a indium tin oxide (ITO) glass slide with the $SnCl_2$ adhesion promoter (left) and without (right). Although in the example of FIG. 10, some of the metal ink has been removed from the adhesion promoter-treated slide (on the left), significantly more of the metal ink is removed during the scratch test from the glass slide that was not treated with the adhesion promoter.

Thus, the invention provides, among other things, a method for printing metal inks on a substrate using an adhesion promoter to provide a conductive bonding between the deposited metal and the substrate. Various features and advantages of the invention are set forth in the following claims.

What is claimed is:

1. A method for printing metal on a substrate, the method comprising:

depositing an adhesion promoter on a surface of the substrate, wherein the adhesion promoter reacts to form a covalent bond with the substrate; and printing with a reactive metal ink on the substrate using a drop-on-demand printing process, wherein the reactive metal ink includes metal cations that react with the adhesion promoter-treated substrate surface to form a conductive bond between the adhesion promoter-treated substrate surface and a metal of the reactive metal ink, and wherein depositing the adhesion promoter on the surface of the substrate includes depositing a tin chloride solution.

2. The method of claim 1, wherein printing with the reactive metal ink on the substrate includes printing with a silver metal-based ink, and wherein silver metal cations of the silver metal-based ink form conductive bonds between tin from the tin chloride solution and silver from the silver metal-based ink.

3. The method of claim 2, wherein the printing with the silver metal-based ink creates a substrate-tin-silver interface that is mechanically strong and that possesses low specific contact resistance in a range of $1\text{-}60\times10^{-4}$ Ohm-$cm^2$.

4. The method of claim 1, wherein depositing the tin chloride solution includes depositing a solution including tin chloride, a pH adjusting agent, a humectant, a viscosity adjusting agent, a surface tension adjusting agent, and a diluting solvent.

5. The method of claim 4, wherein the pH adjusting agent includes at least one selected from a group consisting of an acid and a buffer, wherein the humectant includes at least one selected from a group consisting of 2,3-butandiol and glycerol, wherein the viscosity adjusting agent includes at least one selected from a group consisting of ethanol, acetone, water, glycerol, and glycerin, wherein the surface tension adjusting agent includes at least one selected from a group consisting of ethanol, sodium citrate, and water, and wherein the diluting solvent includes at least one selected from a group consisting of water, ethanol, acetone, acids, and a polar solvent.

6. The method of claim 1, wherein the tin chloride solution has a concentration between 1 femto-moles per liter and 20.84 moles per liter and has a pH between 0 and 7.

7. The method of claim 1, wherein depositing the adhesion promoter on the surface of the substrate includes printing with the adhesion promoter on the surface of the substrate using a drop-on-demand printing process.

8. The method of claim 7, wherein printing with the adhesion promoter on the surface of the substrate includes printing with the adhesion promotor in a location and pattern that the reactive metal ink is to be printed.

9. The method of claim 8, wherein printing with the reactive metal ink on the substrate including printing with the reactive metal ink only in the same location and pattern where the substrate was previously printed with the adhesion promoter.

10. The method of claim 1, further comprising heating the substrate to a temperature above 90° C., and wherein printing with the reactive metal ink on the substrate using the drop-on-demand printing process includes printing with the reactive metal ink on the substrate after the substrate is heated to the temperature above 90° C.

11. The method of claim 1, wherein the substrate is selected from a group consisting of a metal substrate, a semiconductor substrate, and a dielectric substrate.

12. A method for printing metal on a substrate, the method comprising:

depositing an adhesion promoter on a surface of the substrate, wherein the adhesion promoter reacts to form a covalent bond with the substrate;

printing with a reactive metal ink on the substrate using a drop-on-demand printing process, wherein the reactive metal ink includes metal cations that react with the adhesion promoter-treated substrate surface to form a conductive bond between the adhesion promoter-treated substrate surface and a metal of the reactive metal ink;

heating the substrate to a temperature above 90° C., and wherein printing with the reactive metal ink on the substrate using the drop-on-demand printing process includes printing with the reactive metal ink on the substrate after the substrate is heated to the temperature above 90° C.; and wherein printing with the reactive metal ink further includes printing with the reactive metal ink in an inert atmosphere to eliminate oxidation at elevated temperatures.

13. A method of producing a solar cell, the method comprising:

at least partially coating a substrate with a metal material;

depositing an adhesion promoter on a surface of the metal-coated substrate, wherein the adhesion promoter reacts to form a covalent bond with the metal-coated substrate; and forming one or more electrical contacts on the metal-coated substrate by printing the one or more electrical contacts on the metal-coated substrate with a reactive metal ink using a drop-on-demand printing process, wherein the reactive metal ink includes metal cations that react with the adhesion promoter-treated substrate surface to form a conductive bond between the adhesion promoter-treated substrate surface and a metal of the reactive metal ink.

14. The method of claim 13, further comprising:

depositing a positively doped layer on a first side of the substrate prior to at least partially coating the substrate with the metal material; and depositing a negatively doped layer on the second side of the substrate prior to at least partially coating the substrate with the metal material.

15. The method of claim 14, wherein the positively doped layer and the negatively doped layer include a-Si:H deposited on the substrate using plasma-enhanced chemical vapor deposition.

16. The method of claim 13, wherein at least partially coating the substrate with the metal material includes at least partially coating a front contact surface and a back contact surface of the substrate with indium tin oxide.

17. The method of claim 16, further comprising forming a back contact on the back contact surface of the substrate by depositing a silver (Ag) layer on the back contact surface of the substrate.

18. The method of claim 13, wherein the substrate includes a silicon wafer.

19. The method of claim 13, wherein depositing the adhesion promoter on the surface of the metal-coated substrate includes depositing the adhesion promoter by printing a first pattern on the metal-coated substrate using the adhesion promoter, and wherein forming the one or more electrical contacts on the metal-coated substrate includes printing the first pattern on the metal-coated substrate using the reactive metal ink.

* * * * *